United States Patent [19]

De Haven et al.

[11] Patent Number: 4,777,863

[45] Date of Patent: Oct. 18, 1988

[54] SHELL FEEDING APPARATUS FOR GUNS

[75] Inventors: Vernet F. De Haven, Huron; Francis J. Warin, Oak Harbor, both of Ohio

[73] Assignee: ARES, Inc., Port Clinton, Ohio

[21] Appl. No.: 110,029

[22] Filed: Oct. 13, 1987

Related U.S. Application Data

[60] Continuation of Ser. No. 820,993, Jan. 22, 1986, abandoned, Division of Ser. No. 549,265, Nov. 4, 1983, Pat. No. 4,640,182.

[51] Int. Cl.[4] ..... F41F 17/16; F41F 9/06; F41D 10/00

[52] U.S. Cl. ..... 89/33.1; 89/47

[58] Field of Search ..... 89/47, 33.02, 33.1

[56] References Cited

U.S. PATENT DOCUMENTS

| | | | |
|---|---|---|---|
| 3,043,105 | 7/1962 | Hagerty | 89/33.02 X |
| 3,241,447 | 3/1966 | Christiansson | 89/47 |
| 4,457,209 | 7/1984 | Scheurich et al. | 89/47 X |

*Primary Examiner*—John F. Terapane
*Assistant Examiner*—John S. Maples, Jr.
*Attorney, Agent, or Firm*—Allan R. Fowler

[57] ABSTRACT

Shell feeding apparatus for a rapid fire, gun, such as a medium caliber cannon, comprises an elongate, linear shell rammer having a relatively small diameter, surrounded by a carousel-type shell magazine configured for holding several, for example, about six, shells. The shell rammer includes a pressurized fluid actuation cylinder having two transversely separated bores and two pistons mounted in the bores. Protruding ends of the pistons are interconnected by a motion multiplier which comprises a T-shaped member, to opposite sides of which are mounted two pairs of sprockets. A shell ramming member is fixed to two drive chains entrained over the two pairs of sprockets. The drive chains are fixed to the actuator cylinder so that when pressurized fluid moves the pistons, relative to the cylinder, a distance, "d", at a velocity, "v," the shell ramming member, and hence a shell engaged thereby, is moved a substantially greater distance, "D," at a substantially greater velocity, "V." Typically the shell ramming distance, "D," and velocity, "V," are twice as great as the actuation distance, "d," and velocity, "v." The shell rammer functions as a spindle for the magazine which includes means for moving shells held thereon to a shell ramming position at which the shells are engaged by the shell ramming member.

12 Claims, 5 Drawing Sheets

210
186
188
40
22
216
42
204
220
218
224
236
238
240
222
198
254
270
32
268
176
5
128
144
122
272
212
214
148
178
82
180
24
124
96
120
274
174
152
172
256
252
266
170
168
150
184
246
248
242
282
278
182
280
154
244
284
250
130
86
286
190
108
84
112
228
276
226
72

SHELL FEEDING APPARATUS FOR GUNS

This invention was made with Government Support under DAAK10-82-C-0049 awarded by the Department of Defense. The Government has certain rights in this invention.

This application is a continuation of application Ser. No. 06/820,993 filed 01/22/86, now abandoned, which is a division of application Ser. No. 549,265, filed 11/4/83 now U.S. Pat. No. 4,640,182, issued 2/3/87.

BACKGROUND OF THE INVENTION

1. Field of the Invention:

The present invention relates generally to the field of automatic or rapid-fire guns and more particularly to shell feeding apparatus for automatic or rapid-fire cannon.

2. Discussion of the Prior Art:

Many types of automatic or rapid-fire guns are produced for military weapon systems. For most of such weapon systems, fast firing rates are required, with the required firing rates ordinarily bearing some relationship to gun caliber so that smaller calibre guns typically have higher firing rates than larger caliber guns. This caliber relationship to firing rate is attributable, for example, by the relatively greater ease with which small calibre shells can be fed to guns and the general capacity for storing or carrying comparatively larger supplies of small calibre ammunition. Moreover, since larger calibre guns have relatively large, massive moving parts, allowable stress considerations limit speed of operation.

As above-mentioned, one firing rate limiting factor is ability to feed shells to the gun in a rapid and, at the same time, reliable manner. Feeding of shells to small calibre guns, such as automatic rifles and submachine guns is usually relatively simple; although, reliable feeding may often still be a problem. Typically for such small arms, shell clips or drum magazines are used, springs in the clips or drums causing the serial advancing of shells into the gun as the gun is fired. Larger automatic guns, including machine guns and smaller calibre automatic cannon, typically use belt held ammunition, the belt, and hence the shells contained therein, being advanced in response to, or in unison with, firing of the gun.

Because loaded ammunition belts for medium calibre cannon shells, for example, those in the 30 to 40 mm size, tend to be too heavy to advance rapidly to the gun and also tend to be too stiff to permit the wide range of movement required for most guns of that calibre, other shell loading means are typically provided for medium calibre cannon. As an illustrative example, U.S. Pat. No. 4,348,938 discloses a two stage shell feeding apparatus in which "free" shells are advanced to a rotary shell feeder by a reciprocating slide mechanism. In turn, the rotary shell feeder rapidly rotates the advanced shells to a loading or pickup position of an associated gun. From this pickup position a gun bolt, on counterrecoil, strips the shells and rams them forwardly into a firing chamber for firing. Although very useful for a wide range of cannon calibres, these dual feeders are not particularly adaptable for large calibre (for example, 75 mm and larger) cannon since, for one reason, most larger calibre automatic or rapid fire cannon do not operate on a reciprocating bolt principle.

As a result, other types of mechanized shell loading apparatus are required for relatively large calibre, rapid fire cannon and, in particular, innovative shell feeders are required for pivoting breech cannon of the type disclosed in copending U.S. patent application Ser. No. 559,304, filed Dec. 9, 1983. Difficult problems are, for example, associated with providing fast-acting, reliable shell feeders for pivoting breech guns, especially when such factors as the space constraints imposed by mobile weapons systems must be taken into consideration.

Additional operational difficulties are also routinely encountered in fully integrating the shell feeder not only with the particular gun-type involved but also with the associated shell magazine from which the feeder receives shells for feeding to the gun.

It is, therefore, an object of the present invention to provide a shell feeder or rammer for a pivoting breech-type gun or the like, the rammer having a motion multiplying portion which enables a rapid, comparatively long shell ramming stroke while requiring only a relatively short actuation stroke.

Another object of the present invention is to provide a shell feeder or rammer which is integrated with a rotary-type magazine such that the rammer is disposed along the rotational axis of the magazine.

A further object of the present invention is to provide a rapid acting shell rammer for feeding telescoped shells into the breech of a pivoting breech-type rapid fire cannon.

Other objects, features and advantages of the present invention will be readily apparent from the following detailed description when taken in conjunction with the accompanying drawings.

SUMMARY OF THE INVENTION

In accordance with the present invention, a shell feeding apparatus for sequentially feeding shells to the chamber of a rapid-fire gun includes a rotatable shell magazine integrated with a coaxial shell ramming means which forms the spindle upon which the magazine rotates.

The shell magazine is generally cylindrical, and supports a plurality of shells in a generally parallel annular array. The ramming means is nested in the shell magazine and is extendible therefrom to sequentially ram shells into the chamber of the gun directly from their magazine storage position as the shell magazine is rotated. And, means are provided for rotatably driving and indexing the shell magazine with respect to the ramming means.

Shell ramming apparatus according to the present invention and for rapidly moving ammunition towards a gun comprises an actuator having first and second portions, the second portion being linearly movable, relative to the first portion, a distance, d, between retracted and extended positions.

The actuator first portion is generally U-shaped, having first and second generally parallel legs in which are formed respective first and second cylinder bores. Comprising the actuator second portion are first and second pistons disposed, respectively, in the first and second cylinder bores, each piston having a piston rod which extends beyond an open end of the bore in which it is disposed. Further comprising the actuator are means interconnecting the extending ends of the piston rods. Actuating means are provided for causing the actuator second portion to move between the retracted and extended positions at a linear velocity, v. Motion multiplying means are mounted to the means interconnecting the pistons, a shell ramming member being connected to the motion multiplying means. The motion multiplying means are configured for causing, in conjunction with the actuating means moving the actuator second portion from the retracted to the extended positions, movement of the shell ramming member a linear shell ramming distance, D, at a shell ramming velocity, V. The shell ramming distance, D, and velocity, V, are substantially greater than, and preferably about twice, the respective actuating distance, d, and velocity, v.

The motion multiplying means include drive means mounted on the actuator second portion for moving the shell engaging member the shell ramming distance, D, at the shell ramming velocity, V, in response to the actuation means moving the actuator second portion the distance, d, at the velocity, v. Comprising the drive means are an endless loop drive belt and at least two guide elements over which the belt is entrained, the guide elements being mounted in a mutually spaced apart relationship to the actuator second portion. The drive belt is fixed to the actuator first portion at least at one point and the shell ramming member is connected to the drive belt. Preferably the drive belt comprises a bicycle-type chain and the guide elements comprise sprocket wheels which are rotatably mounted to the actuator second portion. Also preferably a line between the rotational axis of the sprockets is parallel to the direction of travel of the actuator second portion and the shell loading direction.

Consistent with the double bored actuator first portion, the piston rod interconnecting means comprise a generally T-shaped member having a cross-piece and an elongate leg, the piston rods being connected at opposite end regions of the cross-piece so that the elongate leg extends between the two legs of the actuator first portion. There may be used two drive chains and two pairs of sprockets, each chain being entrained over two sprockets so that the two chains lie in mutually parallel planes in a symmetrical manner on opposite sides of the T-shaped member. The shell ramming member is connected to both chains and both chains are connected at a point to the actuator first portion. The motion multiplying means further comprises buffering means for absorbing mechanical impact shock at both extremes of travel of the shell ramming member.

The shell ramming apparatus, according to the present invention, may further comprise a generally cylindrical shell magazine disposed around the actuator, the magazine being configured to hold a plurality of shells. Means are provided for rotatably moving shell holding portions of the magazine so as to sequentially index shells held thereby into a ramming position in which ramming engagement of the shells by the shell ramming member is enabled when the actuator second member is in its retracted position.

The magazine is preferably configured to hold about six shells and the actuator and motion multiplying means are formed to fit into a space about equal in diameter to the diameter of the shells, thereby enabling the shells in the magazine to be tightly clustered in a circle around the actuator and motion multiplying means. The apparatus, including the rammer and shell magazine, may be configured for use with telescoped shells, in which the projectile portion of the shell is fully recessed into the casing portion of the shell.

There results a shell rammer, especially adapted for use with telescoped shells, which is axially short and which is small in diameter, both as may be a requirement in many weapon systems. The rotary magazine, which is configured to hold several immediately available shells and which may be rapidly reloaded, is compactly built around the shell rammer and may be fully integrated therewith so that the shell rammer functions as the spindle of the magazine. Together the shell rammer and surrounding shell magazine form a compact shell feeder which may readily be integrated with various types of breech-loading guns.

BRIEF DESCRIPTION OF THE DRAWINGS

A better understanding of the present invention may be had from a consideration of the following detailed description taken in conjunction with the accompanying drawings, in which.

DESCRIPTION OF THE PREFERRED EMBODIMENT

Figure 1:
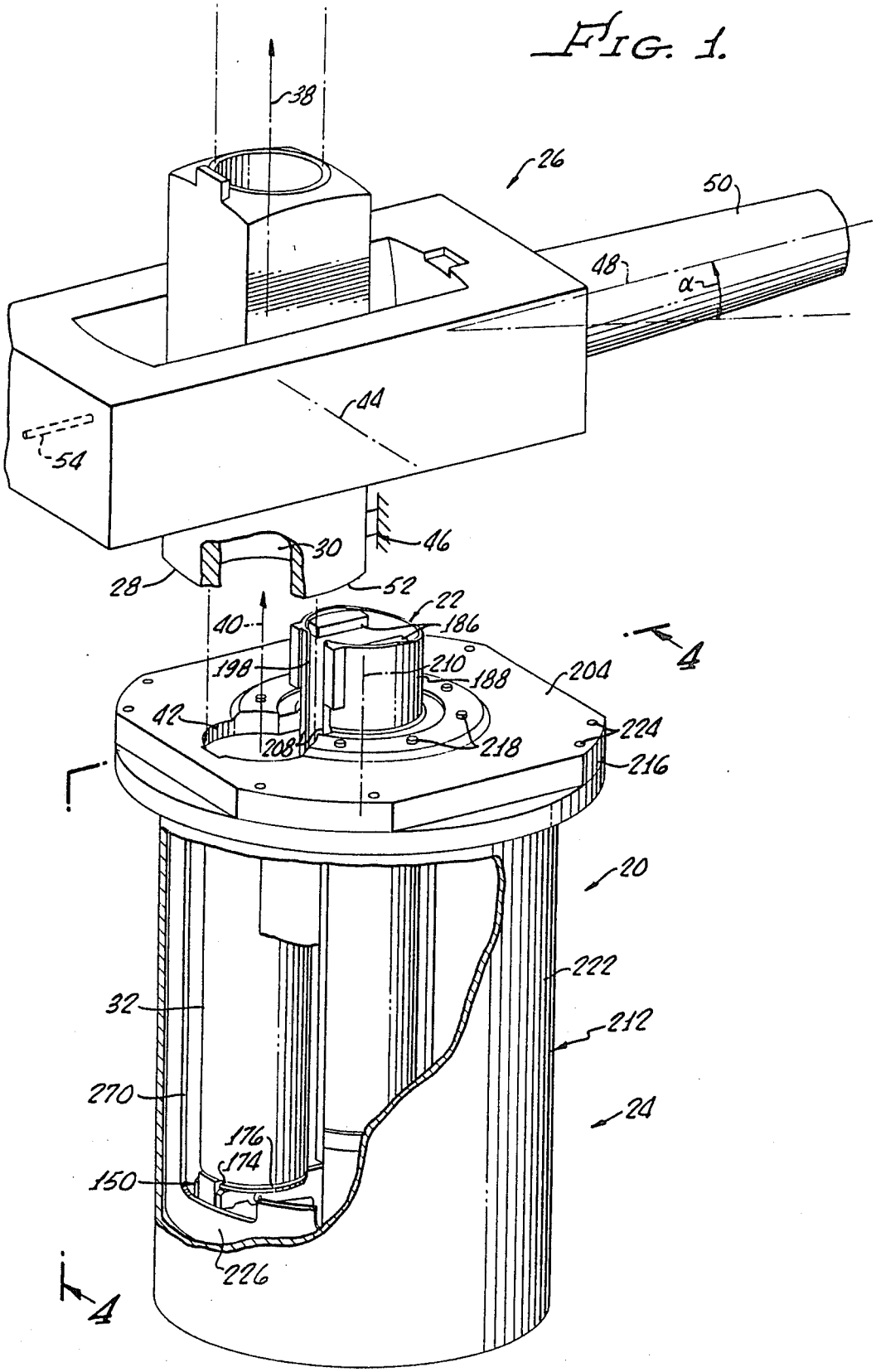
FIG. 1 is a partially cutaway perspective drawing showing the shell feeding apparatus according to the present invention and relative portions of an exemplary rapid fire cannon with which the shell feeding apparatus may be used to advantage.

As shown in FIG. 1, shell (ammunition) feeding apparatus 20, according to the present invention, comprises generally a shell rammer or shell ramming apparatus 22 disposed along the axis of a cylindrically-shaped shell magazine 24. Shown in shell feeding relationship with shell feeding apparatus 20 is an exemplary, rapid-fire gun or cannon 26 constructed so as to have a pivoting shell chamber (breech) 28 into an aperture 30 of which are fed shells 32 by apparatus 20. In particular, exemplary gun 26 is configured for firing canister-shaped, telescoped shells 32 in which projectile portions are fully recessed into a cylindrical shell casing. Chamber aperture 30 is thus cylindrical in shape and shells 32 are fed completely therethrough. That is, fired shell casings are caused to be ejected out of one end of aperture 30 by introduction, by shell rammer 22, of unfired shells 32 into the other end of the aperture. By way of specific example, with no limitations intended or implied, gun 26 may be of the type disclosed in copending U.S. patent application Ser. No. 559,304, filed Dec. 8, 1983.

Accordingly, shell feeding apparatus 20 is illustrated in the drawings and is described herein as being configured for use with shells 32 of the telescoped type abovementioned. However, it is to be appreciated that although shell feeding apparatus 20 is particularly well suited for use with telescoped shells 32, the present invention is not limited to such type shells, but may readily be adapted, in a manner evident to those skilled in the ammunition feeding art, to use with conventionally shaped shells.

Shell feeding apparatus 20 and associated gun 26 are mounted, for example, in a mobile gun system (not shown) in a mutually spaced apart relationship wherein, when gun chamber 28 is pivoted to the full open position depicted by FIG. 1, a longitudinal axis 38 of chamber shell holding aperture 30 is aligned with an axis 40 through a shell fedding aperture 42 of magazine 24 and through a shell 32 positioned in magazine 24 at such aperture. Axis 40 thereby defines a linear shell feeding path from magazine 24 into open gun chamber 28. As shown in FIG. 1, gun chamber 28 pivots between open and closed positions about a transverse axis 44 which passes through a trunnion gun mount (not shown) which enables gun elevational movement. Both shell chamber 28 and the entire gun 26 are thus pivoted (by means not shown) about the same axis (axis 44). A stop 46 is fixed to structure so as to limit pivotal opening movement of chamber 28; as a result of both chamber 28 and gun 26 pivoting about common axis 44 and the position of chamber stop 46, chamber axis 38 always becomes aligned with shell path axis 40 regardless of the elevational angle, "$\alpha$", of bore axis 48 of a gun barrel 50. Moreover, the open end of chamber aperture 30, at a chamber spherically curved end surface 52, is also always, when the chamber is at stop 46, at the same position relative to magazine shell feeding aperture 42. As a result, the length "D", of the shell feeding path, along axis 40, remains constant regardless of the elevational angle, $\alpha$, of barrel 50, as is important to operation of shell feeding apparatus 20, necessity for incorporation of a variable length shell feeding stroke of shell rammer 22 being thereby eliminated.

When shell chamber 28 is pivoted to its fully closed position, chamber aperture axis 38 is aligned with barrel bore axis 48. Therefore, when chamber 28 is fully closed and locked (by means not shown) in such position, a shell 32 contained in chamber aperture 30 may be fired by firing means 54, the shells being fired while remaining in the chamber aperture.

Figures 2A, 2B:
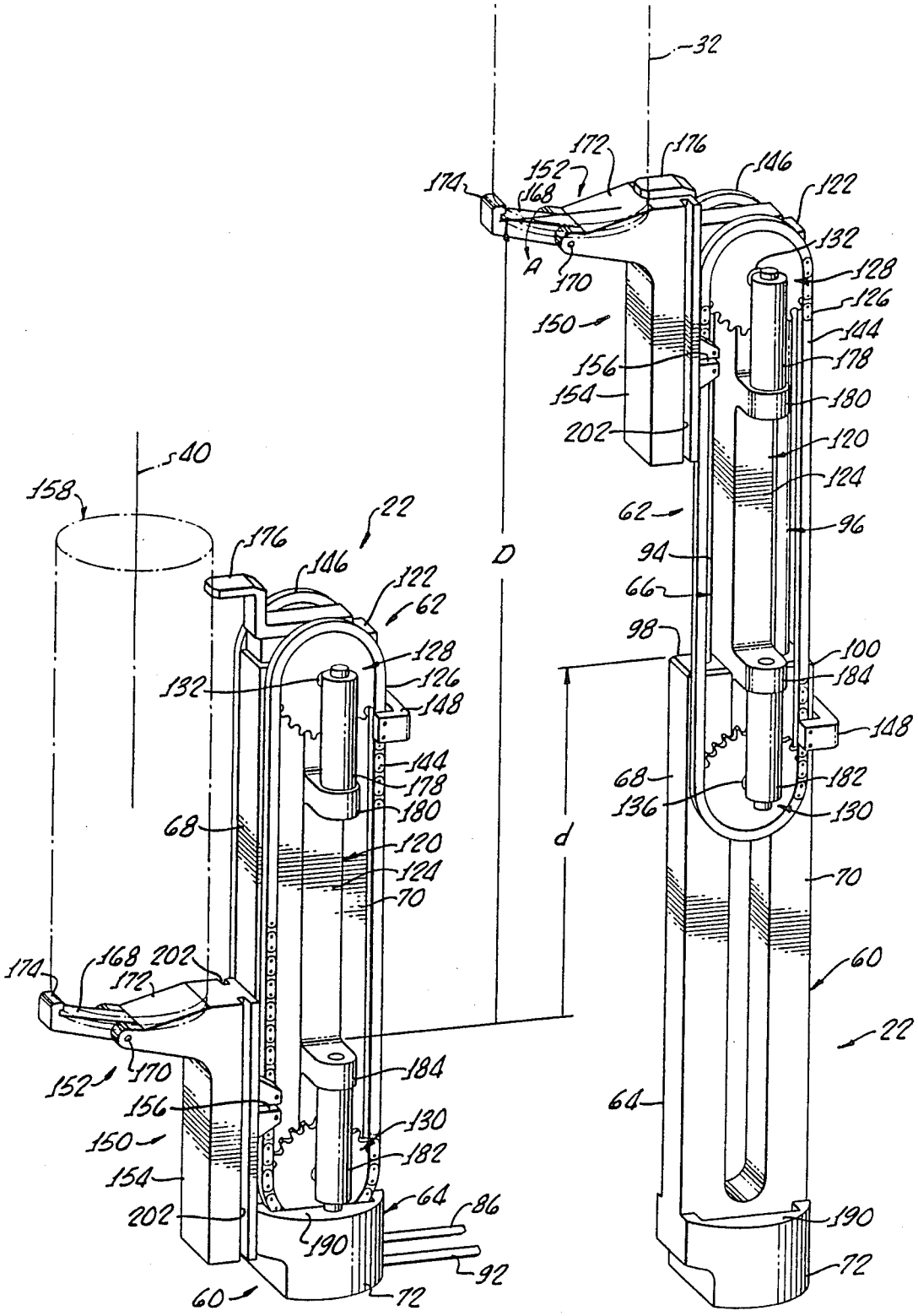
FIG. 2 is a partially cutaway perspective drawing of shell ramming portions of the shell feeding apparatus of FIG. 1, FIG. 2A showing the shell rammer in a retracted condition in readiness for shell feeding and FIG. 2B showing the rammer in a fully extended, shell ramming condition.
Figure 3:
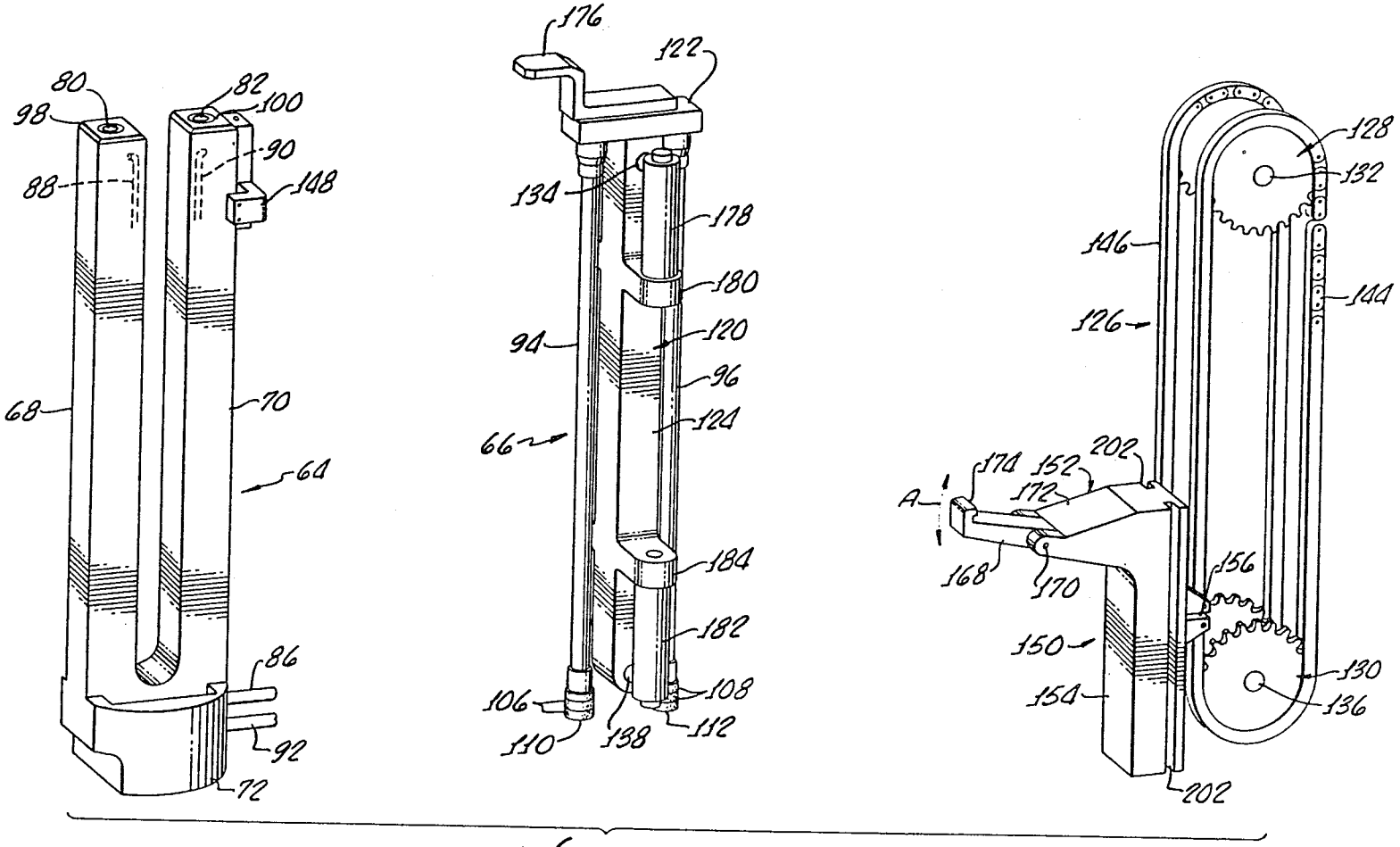
FIG. 3 is an exploded perspective drawing of the shell rammer of FIG. 2, showing actuator and motion multiplying portions thereof.

Described more specifically, and as best seen in FIGS. 2 and 3, shell rammer 22 comprises an externally-powered primary actuator 60 and a secondary actuator or motion multiplying means 62 which is connected, as described below, to the primary actuator. Comprising primary actuator 60 is a first, cylinder portion 64 and a second, piston portion 66, major portions of which are disposed in the cylinder portion.

It has been found advantageous to construct actuator cylinder portion 64 in a general U-shape with similar, first and second cylinder legs 68 and 70, respectively (FIGS. 2 and 5) and an interconnecting base portion 72. Cylinder legs 68 and 70 are laterally spaced apart and are parallel. First and second elongate cylinder bores 80 and 82, respectively, are formed in respective first and second cylinder legs 68 and 70, both the cylinder bores being the same length and diameter and being parallel to one another (FIGS. 3 and 5). A first fluid pressure channel 84 (FIG. 4) formed through base portion 72 interconnects lower regions of cylinder bores 80 and 82 and has connected thereto a fluid pressure "ram up" conduit 86. Small fluid channels 88 and 90 (FIGS. 3 and 5) are formed in cylinder legs 68 and 70, respectively, parallel to, and outwardly from cylinder bores 80 and 82. Channels 88 and 90 communicate with respective cylinder bores 68 and 70 at upper regions thereof. Lower regions of channels 88 and 90 are interconnected by a channel (not shown) formed in cylinder base portion 72, a fluid pressure "ram down" conduit 92 being connected to such interconnecting channel.

Actuator piston portion 66 comprises similar first and second, elongate piston and piston rod assemblies 94 and 90, respectively. Such assemblies 94 and 96 are sized to slidingly fit into respective cylinder bores 80 and 82 and are sufficiently long so that when fully received into the cylinder bores upper (for the vertical orientation shown in the Figures) rod end regions of the assemblies extend beyond upper end surfaces 98 and 100 of respective cylinder legs 68 and 70. Various O-ring pressure seals, such as seals 106 and 108, are installed on piston portions 110 and 112 of piston assemblies 94 and 96 as is known in the art, to provide fluid sealing between the piston assemblies and cylinder bores 80 and 82 (FIG. 3).

Comprising part of motion multiplying means 62 is a rigid, T-shaped member 120 formed having a relatively short cross piece 122 and an elongate leg portion 124 (FIGS. 2 and 3). End regions of cross piece 122 are connected to the upper end regions of piston assemblies 94 and 96 which project, upon retraction of actuator 60, from open ends of cylinder bores 80 and 82. Cross piece 122 is connected to piston assemblies 94 and 96 so that the elongate leg 124 of member 120 extends between the piston assemblies and hence, upon assembly, between the cylinder legs 68 and 70, when the piston assemblies are retracted into cylinder bores 80 and 82.

Mounted to member 120, and, hence, also forming part of motion multiplying means 62, are chain drive means 126. Included in chain drive means 126 are first and second, sprocket-type drive wheel pairs 128 and 130, respectively. First drive wheel pair 128 is mounted to member 120 by a first shaft 132 which is rotatably mounted through an aperture 134 formed transversely through upper end regions of member leg 124, one of the drive wheels being fixed on shaft 132 to one side of leg 124 and the other one of the drive wheels being fixed to shaft 132 on the other side of the leg. In a like manner, drive wheel pair 130 is mounted to member 120 by a second shaft 136 which is rotatably mounted through an aperture 138 at the free (lower) end of member leg 124, one of the drive wheels being fixed to shaft 136 on one side of leg 124 and the other one of the drive wheels being fixed to shaft 136 on the other side of the leg. Drive wheel pairs 128 and 130 are fixed to shafts 132 and 136 so that corresponding pairs of drive wheels comprising one each of pairs 128 and 130 are aligned in two parallel, common planes, one such common plane being on one side of member 120 and the other common plane being on the other side of the member.

A first, endless-loop drive chain 144 of a bicycle-chain type is entrained over one of the corresponding pair of drive wheels 128 and 130 and a similar second drive chain 146 is entrained over the other one of the corresponding pair of drive wheels. Accordingly, the two drive chains 144 and 146 lie in the above-mentioned parallel planes on opposite sides of member 120, preferably in a symmetrical manner relative to member 120 and, as well, to actuator 60.

Both drive chains 144 and 146 are fixed at a point to upper end regions of actuator cylinder leg 70 by a bracket 148. As a result of such drive chain connection, when member 120 to which the drive chains 144 and 146 are mounted is extended, with piston assemblies 94 and 90, relative to actuator cylinder 60 (by application of fluid pressure through "ram up" line 86) the drive wheel pairs 128 and 130 are caused to rotate and other regions of the drive chains are caused to move relative to the actuator cylinder.

A shell ramming member 150 is provided which has a "horizontal" (in the feeder orientation shown in the Figures), shell base engaging leg 152 and a "vertical" chain mounting leg 154. Member 150 is connected to drive chains 144 and 146 at a region 156 of vertical leg 154, for example, by pins (not shown). Alternatively each of the drive chains 144 and 146 may be formed in two sections, each section being attached to the rammer member leg region 156 and the other end of each section being attached to bracket 148 which fixes a point of the drive chains to actuator cylinder leg 70.

As shown in FIG. 2, shell ramming member 150 is connected to drive chains 144 and 146 in a location causing shell base engaging leg 152 to be in a lowermost position below an adjacent shell ramming position 158, (FIG. 2*a*) when actuator piston portion 66 is in its fully retracted (non-ramming) position. Because of the described attachments of shell rammer drive chains 144 and 146 to non-moving portions of actuator 60 (that is, to cylinder leg 70) when actuator piston assembly 66, with member 120 on which the drive chains are mounted, is moved, by fluid pressure applied via conduit 86 a linear distance, "d", at a velocity, "v", from its fully retracted position (FIG. 2*a*) to its fully extended position (FIG. 2*b*), shell ramming member 150 is caused to be moved a substantially greater linear distance, "D", at a substantially greater velocity, "V". In fact, shell ramming distance, "D" is twice as great as piston movement distance "d", and accordingly, the ramming velocity, "V", is twice as great as piston velocity, "v".

It is evident from FIG. 1 that the shell ramming distance, "D", must be at least twice the length of shells 32 in order to provide structural clearances after the shells are rammed out of magazine 24 and to enable full shell insertion into chamber aperture 30. However, the corresponding piston actuation distance, "d", is required to be only about one shell length, which thereby enables shell rammer 22 to be almost fully recessed into magazine 24, as is very important for apparatus compactness and system space conservation.

Shell engaging leg 152 of shell ramming member 150 is, as shown in FIGS. 2 and 3, constructed having an outboard portion 168 which is pivotally hinged by a pin 170, to an inboard portion 172. Spring means (not shown) enable outboard portion 168 to pivot downwardly counterclockwise (direction of Arrow "A"). Such downward pivoting is necessary to enable an inwardly projecting, shell gripping portion 174 of outboard portion 168 to snap into an annular groove 176 formed around shells 32 just above their lower ends as the shell ramming movement of ramming member 150 is initiated (FIG. 1). Such pivoting of ramming member outboard portion 168 also enables shell gripping region 174 to be automatically disengaged (by means not shown) from shell groove 176 when a shell 32 has been fully inserted, by shell rammer 22, into chamber aperture 30.

A ramming member stop 176 is fixed to the top of crosspiece 122 of member 120 in the path of travel of shell ramming member 150 to limit the ramming travel thereof. A pair of "ram up" shock absorbing buffers 178 are connected to sidewardly projecting upper ears 180, formed on vertical leg 124 of member 120.

Figure 4:
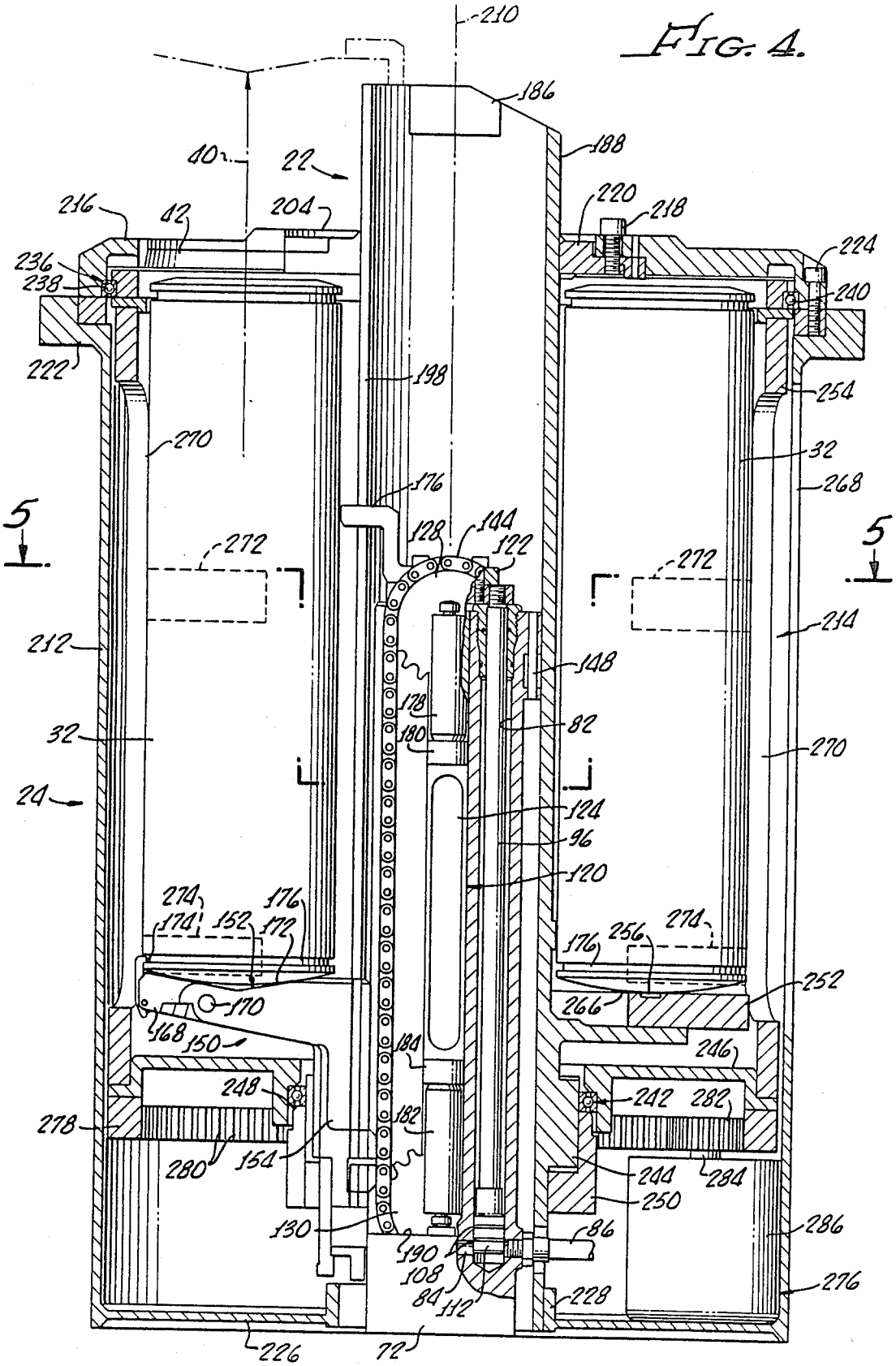
FIG. 4 is a longitudinal (vertical) cross-sectional view taken along lines 4—4 of FIG. 1 showing features of the shell feeding apparatus.
Figure 5:
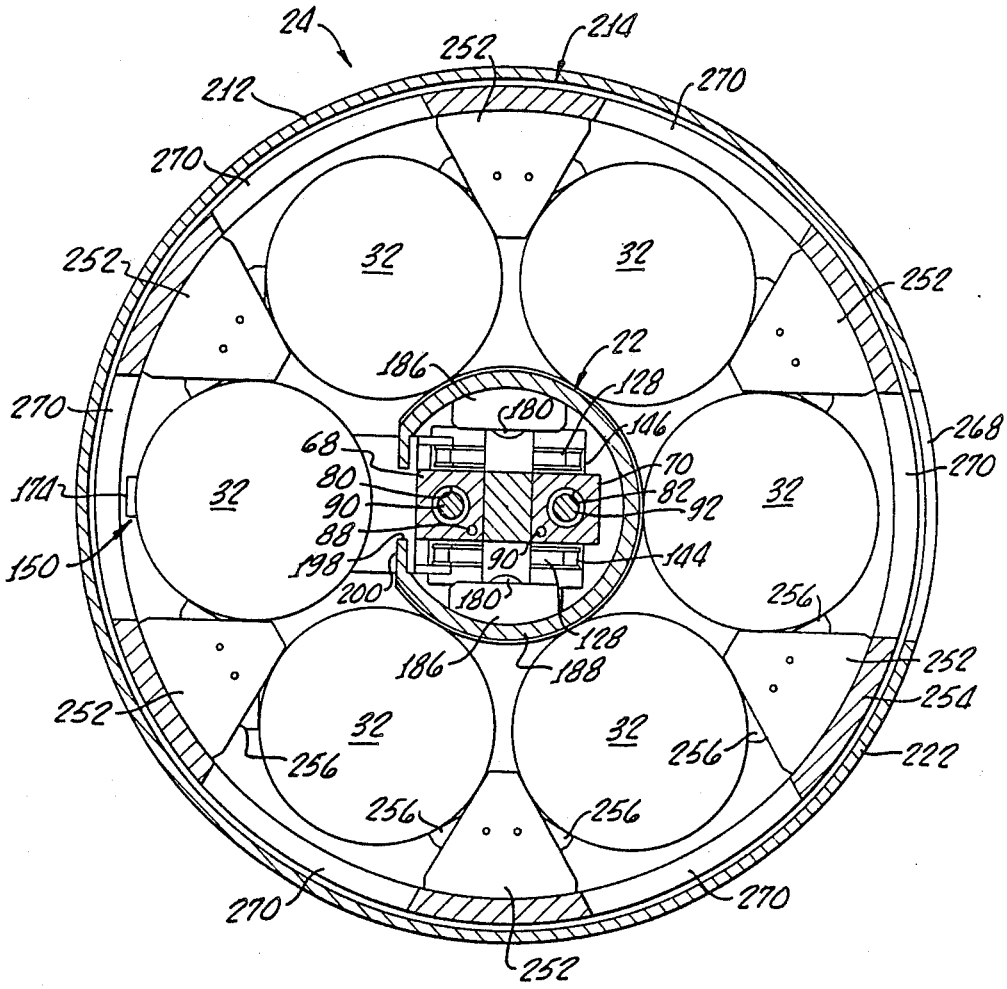
FIG. 5 is a transverse (horizontal) cross-sectional view, taken along lines 5—5 of FIG. 4 showing additional features of the shell feeding apparatus.

In a similar manner, a pair of "ram down" shock absorbing buffers 182 are connected to sidewardly projecting lower ears 184 formed on such leg (FIGS. 2-4). Upon shell ramming actuation of actuator 60, when piston assembly 66 closely approaches its fully extended postion, "ram up" buffers 178 impact corresponding blocks 186 fixed to upper, inner regions of a tubular sleeve or housing 188 within which actuator 60 and motion multiplying means 62 are disposed. Subsequently, during retraction of piston assembly 66, to return shell ramming member 150 to its lower-most position, "ram down" buffers 182 impact corresponding upper surfaces 190 of cylinder base portion 72. Accordingly, buffers 178 and 182 function to absorb impact shock at both extremes of travel of piston assemblies 94 and 96 relative to actuator cylinder 64.

As above-mentioned, housing 188 is configured to enclose actuator 60 and motion multiplying means 62. To provide clearance for shell ramming member 150, a slot 198 is formed down one side of housing 188. Upon assembly, side edge regions 200 of slot 198 fit into corresponding side recesses 202 formed along vertical leg 154 of shell ramming member 150, slot edge regions 200 thereby functioning as guides for the shell ramming member. The height of housing 188 above an upper surface 204 of magazine 24 is selected, according to ramming travel distance, D, to assure that at least major portions of shell ramming member 150 remains within housing slot 198, so that guiding engagement is maintained between slot edges 200 and rammer member grooves 202.

Although shell rammer 22 is depicted in FIGS. 1-5 as having a central longitudinal axis 210, vertically oriented, and although various portions of the shell rammer have been described in such terms as "upper", "lower", "vertical", "horizontal", and "ram up" or ram down", it is to be appreciated that vertical orientation is not essential. Orientation of shell rammer 22 so that central axis 210 is at an angle to the vertical or is even horizontal, as may be necessary or desirable for some weapons systems, is alternatively possible without substantially affecting operation thereof. However, additional shell guiding, as will be apparent to those skilled in the ammunition feeding out, may be required if shell rammer 22 is not vertically oriented.

When shell rammer 22 is configured for use with medium calibre ammunition, for example, with 75 mm shells, a large, immediately available supply of shells may not be required for some or many weapons systems. As an illustration, for use in light assault vehicle weapons systems in which gun system space is severely limited and sustained firing requiring large numbers of instantly available ammunition is not a specified requirement, a relatively small and compact shell magazine holding only a relatively few, for example, six, shells may be used to advantage. Such magazines, of course, are ordinarily required to be easily reloadable with shells stored elsewhere in, or relatively adjacent to, the magazine.

Because of its relatively small size, shell rammer 22 can readily be integrated with a cylindrical, carousel-type magazine shown in FIGS. 1, 4 and 5 as magazine 24.

Magazine 24 is configured for holding a plurality of shells 32 of the telescope type. Preferably, and as shown in FIGS. 1, 4 and 5, magazine 24 is configured for holding six shells 32 in such a manner that the shells are tightly clustered, in a side-by-side arrangement, on a circle around shell rammer 22. Consequently, rammer housing 188 is enabled to function as the spindle for magazine 24, rammer axis 210 thereby also being the rotational axis of moveable portions of the magazine, as described below.

In order to be compatible with such a tight circular clustering of six shells in magazine 24, shell rammer 22 is constructed so that the outer diameter of rammer housing 188 is about equal to one shell diameter. Thus, for example, for use with telescoped shells 32 employing a 75 mm projectile, the outer diameter of rammer housing 188 may be only about 5.25 inches. Such a small required outer diameter of rammer 22 imposes constraints on the rammer which have been found to be satisfied by the illustrated and above-described configuration of the rammer.

Comprising shell magazine 24 is a rigid outer housing assembly 212 and a shell holder 214 which is rotatably mounted within the housing (FIGS. 1, 4 and 5). In general, magazine housing 212 is in the shape of a cylindrical shell having a circular transverse cross-section. A circular top plate portion 216 of magazine housing 212 is detachably connected, by a plurality of bolts 218, to a circular flange 220 which is fixed to (as by welding), and projects radially outwardly from, rammer housing 188 near the top thereof. Upper regions of a longitudinal, tubular wall 222 of magazine housing 212 is detachably connected to outer peripheral regions of top plate portion 216 by a plurality of bolts 224. A transverse bottom plate portion 226 of housing 212, which projects inwardly from lower regions of wall 222 has a circular, inner peripheral surface 228 which abuts against lower regions of rammer housing 188.

Shell holder 214 is rotatably suspended from magazine housing top plate 216 by an annular bearing 236 which is installed in annular grooves 238 and 240 formed, respectively, into inner regions of plate 216 and outer regions of the shell holder. A second annular bearing 242, of the thrust type, is installed between a lower, enlarged diameter portion 244 of rammer housing 188 on an annular bottom plate portion 246 of shell holder 214. Second bearing 242 rests on upper surface 248 of a tubular member 250 attached to housing portion 244. A plurality of triangular-shaped (six, as shown) shell supporting members 252, one located between each adjacent pair of shell holding positions (FIG. 5), are fixed to an outer wall 254 of shell holder 214. Small spring-loaded shell engaging elements 256 are mounted in converging side regions of each shell supporting member (two elements being provided for each member) in locations providing support for shells 32 held in shell holder 214. Shell engaging elements 256 may, as shown, support shells 32 by a bottom hemispherically curved surface 266 thereof, or may alternatively support the shells by engaging annular groove 176 which is formed at the shell base.

Magazine housing wall 222 is formed having a shell loading aperture 268 (FIGS. 4 and 5) which may be closed by a door (not shown) except when loading shells 32 into shell holder 214. Shell loading aperture 268 is, as shown, preferably formed in housing wall 222 in a location remote from shell ramming member 150, for convenience in loading shells 32 into shell holder 214. A plurality of inner, shell loading apertures 270 are thereby provided for the six shell capacity magazine 24 shown in the Figures and described herein. Shells 32 are accordingly loaded into shell holder 214 through housing aperture 268 and the various inner apertures 270.

Means are provided for holding shells 32 in place after they have been loaded into shell holder 214. Such means may, for example, comprise resilient upper and lower strips 272 and 274, respectively, attached to inner regions of shell holder wall 254 (FIG. 4).

As has been above-described, magazine housing 212 is rigidly connected to rammer housing 188; whereas, shell holder 214 is free to rotate, supported on bearings 236 and 242, around the rammer housing and within the magazine housing. Consequently, shells 32 held in shell holder 214 can be rotated into registration with shell ramming position 158 which is located at the beginning of the shell ramming path along axis 40.

Various means may be provided for causing shell feeding rotation of shell holder 214 about shell rammer 22, which, as above-mentioned, functions as a spindle for magazine 24. For example, as shown in FIG. 4, electric drive means 276 are provided for rotatably indexing shell holder 214 so as to sequentially index shells 32 held in the shell holder into shell ramming position 158 for loading by shell rammer 22 into gun breech 28. Comprising drive means 276 is an annular "rack" gear 278 which is fixed to the bottom of shell holding bottom plate 246. Teeth 280 of gear 278 face inwardly towards magazine axis 210. Mounted in driving relationship with rack gear 278 is a pinon gear 282 which is mounted on a drive shaft 284 of an associated drive motor 286. Such motor 286 may, for example, be an electric motor or a hydraulic motor. Sequencing means (not shown) are included for causing intermittant operation of motor 286 in a manner causing the stepwise advancing of shells 32 held in shell holder 212 into shell ramming position 158 in coordination with "ram up" and "ram down" movement of shell ramming member 150.

Although there has been described above a specific arrangement of a shell feeding apparatus, including a shell rammer and shell magazine, in accordance with the present invention for purposes of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. Shell feeding apparatus for a rapid fire gun, said apparatus comprising:

(a) shell ramming means for rapidly moving shells in a linear direction a shell ramming distance, D, from a shell ramming position alongside and off-axis from the ramming means into an open breech of an associated rapid-fire gun;

said shell ramming means including an actuator having a first portion fixed relative to said gun and a second portion which is movable between a retracted position and an extended position, a linear distance, d, in respect to said first position in a direction parallel to the shell ramming direction and including means for causing said actuator second portion to move said distance, d, said shell ramming means further including a shell ramming member and a motion multiplier, said shell ramming member being connected to said motion multiplier and said motion multiplier being connected to said actuator second portion so as to cause, in response to said actuator second portion being moved said distance, d, said shell ramming member to move said shell ramming distance, D, so as to ram a shell into said gun breech, said ramming distance, D, being substantially greater than said actuator distance, d; and (b) shell magazine means for holding a plurality of shells, said shell magazine means comprising a generally cylindrical housing centrally disposed around said shell ramming means, shell holding means disposed within said housing for holding said plurality of shells in a side-by-side orientation centrally around said shell ramming means, and means for rotatably indexing said shell holding means so as to cause shells held in said holding means to be sequentially advanced into said shell ramming position.

2. The shell feeding apparatus according to claim 1 wherein said shell holding means include means for loading shells into the shell holding means.

3. The shell feeding apparatus according to claim 1 wherein said motion multiplier comprises a chain drive which includes an endless loop chain and a pair of sprockets over which said chain is entrained, said shell ramming member being connected to said drive chain and said drive chain being connected to said actuator first portion so as to cause said shell ramming member to move said shell ramming distance, D, in response to said actuator second portion being moved said actuator distance, d.

4. The shell feeding apparatus according to claim 1 wherein said shell magazine means are configured for holding about six telescoped shells.

5. Shell feeding apparatus for feeding shells a distance, D, from a shell pickup position to a breech loading position, said shell ramming apparatus comprising:

(a) a pressurized fluid actuator having a U-shaped cylinder portion forming laterally spaced apart first and second legs having respective first and second cylinder bores and further having first and second pistons disposed in respective ones of said bores, said pistons being movable a linear distance, d, relative to said cylinder portion, said distance, d, being substantially less than said shell ramming distance, D;

(b) pressurized fluid means for actuating said actuator;

(c) a shell ramming member;

(d) motion multiplying means connected to said pistons for causing, in response to said pressurized fluid means causing said pistons to move said distance, d, the shell ramming member to move said shell ramming distance, D, said motion multiplying means including a T-shaped member having a transverse portion and an elongate depending leg portion and means for connecting end regions of said T-shaped member transverse portion to said actuator pistons so as to cause said T-shaped member leg portion to be disposed between said actuator cylinder first and second legs at least when said actuator second portion is in the retracted position; said motion multiplying means further including means for movably connecting said shell rammer member to said T-shaped member, said motion multiplying means further comprises a first pair of drive sprockets rotatably mounted in mutually spaced apart relationship on one side of said T-shaped member, a second pair of drive sprockets rotatably mounted in mutually spaced apart relationship on the other side of said T-shaped member, said first and second pair of drive sprockets being symmetrically arranged on opposite sides of said T-shaped member, said motion multiplying means still further comprising a first drive chain entrained over the first pair of drive sprockets and a second drive chain entrained over the second pair of drive sprockets, said first and second drive chains being in mutually parallel planes, said two drive chains being connected at a point to said actuator first portion and said shell ramming member being connected to said two chains so as to be positioned in a shell-engaging position at the ramming position alongside the ramming means when said actuator second portion is in said retracted position and at the breech loading position when said actuator second portion is in the extended position; and (e) an annular shell magazine disposed around said actuator and motion multiplying means, said magazine being configured to hold a plurality of shells and including means for sequentially moving shells held in the magazine into said shell ramming position for ramming by the apparatus into the breech loading apparatus.

6. Shell feeding apparatus for supplying shells to an open cannon breech, said apparatus comprising:

(a) a linear actuator having first and second portions, said second portion being movable relative to the first portion a distance, d, between a retracted position and an extended position;

said first portion being generally U-shaped and having elongate first and second, transversely spaced apart legs;

(b) actuation means for causing the actuator second portion to move said distance, d, at a linear velocity, v;

(c) motion multiplier means comprising an elongate mounting member, a pair of sprockets rotatably mounted to said member in a coplanar, mutually spaced-apart relationship, an endless loop drive chain entrained over said sprockets, and a shell ramming member connected to said drive chain;

(d) means for mounting said motion multiplier to said actuator second portion with a line interconnecting rotational axes of said sprockets parallel to the direction of travel of said second portion;

said mounting means mounting said mounting member to the actuator second portion so as to cause, when the second portion is in the retracted position, major portions of said mounting member to be disposed between the legs of the first actuator portion; and (e) means for connecting said drive chain to said actuator first portion so as to cause, in response to said actuating means moving said actuator second portion said distance, d, at said velocity, v, said shell ramming member to move a distance, D, from a shell pickup position to a shell loading position at a velocity, V, said distance D and said velocity, V, being substantially greater than said distance, d, and said velocity, v, (f) a generally cylindrical shell magazine disposed around said actuator, said magazine being configured to hold a plurality of shells; and, (g) means for rotatably moving said magazine so as to sequentially index shells held therein into a ramming position alongside the ramming means enabling ramming engagement with the shells by said shell ramming member when the actuator second member is in the retracted position and the ramming member is in the shell pickup position.

7. Shell ramming apparatus for rapidly moving ammunition towards a gun, said apparatus comprising:

(a) an actuator having first and second portions, the second portion being linearly movable, relative to the first portion, a distance, d, between retracted and extended positions;

said actuator first portion comprising a cylinder having means defining laterally spaced apart, parallel first and second bores, said actuator second portion comprising first and second pistons disposed, respectively, in said first and second bores, said pistons each having a piston rod which extends beyond an open end of said bores, said actuator including means interconnecting said extending ends of the piston rods and means for delivering pressurized fluid to said first and second bores;

(b) actuating means for causing the actuator second portion to move between the retracted and extended positions at a linear velocity, v;

(c) a shell ramming member;

(d) motion multiplying means mounted to the piston rod interconnecting means, said shell ramming member being connected to the motion multiplying means, said motion multiplying means being configured for causing, in conjunction with the actuating means moving the actuator second portion from the retracted to the extended positions, movement of the shell ramming member a linear shell ramming distance, D, at a shell ramming velocity, V, said shell ramming distance, D, and velocity, V, being substantially greater than the respective actuating distance, d, and velocity, v;

(e) a generally cylindrical shell magazine disposed around said actuator, said magazine being configured to hold a plurality of shells; and (f) means for rotatably moving said magazine so as to sequentially index shells held therein into a ramming position alongside the ramming means enabling ramming engagement with the shells by said shell ramming member when the actuator second member is in the retracted position and the ramming member is in the shell pickup position.

8. The shell feeding apparatus according to claims 7 or 6 wherein said distance, d, is less than the length of shells held in said magazine and said distance, D, is at least as great as said shell length.

9. The shell feeding apparatus according to claims 7 or 6 wherein the line of linear travel of the shell engaging member is parallel to, and offset from, the rotational axis of said magazine.

10. Shell feeding apparatus for a rapid-fire gun, said gun including a chamber for receiving said shells sequentially, said shell feeding apparatus comprising:

(a) a generally cylindrical and rotatable shell magazine for storing a plurality of shells in a generally parallel annular array;

(b) shell ramming means nested in said shell magazine for extending therefrom to sequentially ram said shells directly from their storage position in said magazine into the chamber of said gun as said shell magazine is rotated;

(c) said ramming means being disposed coaxially within said cylindrical shell magazine and forming the spindle upon which the shell magazine rotates;

(d) means for rotating and indexing the shell magazine with respect to the ramming means; and (e) means for driving the ramming means.

11. The apparatus of claim 10 wherein the ramming means includes an elongated housing forming the spindle for the shell magazine, with said housing having a slot extending longitudinally thereof, and wherein the ramming means further includes a ramming member aligned with and extending outwardly from said slot for sequentially engaging rounds carried in the annular array by the rotatable shell magazine.

12. The apparatus of claim 11 wherein the shell magazine stores six shells each of the same given diameter, and wherein the ramming means is generally of cylindrical outer configuration with a diameter approximately equal to that of a shell.

* * * * *